US008905498B2

(12) United States Patent
Hammerle

(10) Patent No.: US 8,905,498 B2
(45) Date of Patent: Dec. 9, 2014

(54) RETRACTING DEVICE FOR RETRACTING A MOVABLY SUPPORTED FURNITURE PART

(71) Applicant: Julius Blum GmbH, Hochst (AT)

(72) Inventor: Hermann Hammerle, Lustenau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/688,787

(22) Filed: Nov. 29, 2012

(65) Prior Publication Data

US 2013/0088132 A1 Apr. 11, 2013

Related U.S. Application Data

(63) Continuation of application No. PCT/AT2011/000189, filed on Apr. 19, 2011.

(30) Foreign Application Priority Data

Jun. 1, 2010 (AT) ..... A 886/2010

(51) Int. Cl.

| | |
|---|---|
| ***A47B 95/00*** | (2006.01) |
| ***A47B 88/00*** | (2006.01) |
| ***A47B 95/02*** | (2006.01) |
| ***A47B 88/04*** | (2006.01) |

(52) U.S. Cl.

CPC ..... *A47B 88/047* (2013.01); *A47B 88/04* (2013.01)

USPC ..... 312/333; 312/319.1; 312/334.8

(58) Field of Classification Search

USPC ..... 312/319.1, 333, 334.7, 334.8, 334.6

See application file for complete search history.

(56) References Cited

U.S. PATENT DOCUMENTS 3,857,618 A * 12/1974 Hagen et al. ..... 384/18
5,302,016 A * 4/1994 Lautenschlager et al. .... 312/333

(Continued)

FOREIGN PATENT DOCUMENTS

CN 1537489 10/2004
CN 1985710 6/2007

(Continued)

OTHER PUBLICATIONS

WO2008034626A2 Translation.pdf.*

(Continued)

*Primary Examiner* — Janet M Wilkens
*Assistant Examiner* — Andrew Roersma
(74) *Attorney, Agent, or Firm* — Wenderoth, Lind & Ponack, L.L.P.

(57) ABSTRACT

A retracting device retracts a movably supported furniture part to the closed end position relative to a furniture body. The device includes a carrier, which can be detachably coupled to the movable furniture part and which is movably supported along a movement path that is linear at least in some sections, and at least one spring device for applying force to the carrier. The spring device can be tensioned by a spring retainer that is separate from the carrier, and the spring retainer is movably supported against or on the carrier. A coupling device is provided in order to couple motion between the carrier and the spring retainer. By the coupling device, the articulated attachment point of the spring device on the spring retainer falls back relative to the position of the moving carrier when the carrier is pulled out, so that the motion of the articulated attachment point of the spring device on the spring retainer is slower than the motion of the carrier.

13 Claims, 17 Drawing Sheets

(56) References Cited

U.S. PATENT DOCUMENTS

| | | | | |
|---|---|---|---|---|
| 6,848,759 | B2 * | 2/2005 | Doornbos et al. | 312/319.1 |
| 7,028,370 | B2 * | 4/2006 | Hoshide et al. | 16/96 R |
| 7,249,813 | B2 * | 7/2007 | Gasser | 312/333 |
| 7,281,773 | B2 * | 10/2007 | Sato et al. | 312/333 |
| 7,374,260 | B2 * | 5/2008 | Lu | 312/333 |
| 7,399,041 | B2 * | 7/2008 | Prentner et al. | 312/333 |
| 7,481,505 | B2 * | 1/2009 | Orita | 312/333 |
| 7,537,296 | B2 * | 5/2009 | Leon et al. | 312/333 |
| 8,205,951 | B2 * | 6/2012 | Boks | 312/319.1 |

FOREIGN PATENT DOCUMENTS

| | | | | |
|---|---|---|---|---|
| DE | 20 2008 000 931 | | 5/2009 | |
| DE | 10 2008 045 418 | | 3/2010 | |
| DE | 20 2008 016 409 | | 4/2010 | |
| EP | 0 391 221 | | 9/1995 | |
| EP | 1 470 769 | | 10/2004 | |
| EP | 2 082 667 | | 7/2009 | |
| GB | 2 297 578 | | 8/1996 | |
| JP | 2007260011 | A * | 10/2007 | A47B 88/00 |
| WO | WO 2008034626 | A2 * | 3/2008 | |
| WO | 2009/044783 | | 4/2009 | |
| WO | 2009/132626 | | 11/2009 | |
| WO | 2010/066608 | | 7/2010 | |
| WO | WO 2010143352 | A1 * | 12/2010 | A47B 88/04 |
| WO | 2011/015663 | | 2/2011 | |
| WO | 2011/056792 | | 5/2011 | |

OTHER PUBLICATIONS

International Search Report issued Aug. 8, 2011 in International (PCT) Application No. PCT/AT2011/000189.

Austrian Patent Office Search Report completed Mar. 1, 2011 in Austrian Patent Application No. A 886/2010.

* cited by examiner

RETRACTING DEVICE FOR RETRACTING A MOVABLY SUPPORTED FURNITURE PART

BACKGROUND OF THE INVENTION

The present invention concerns a retraction device for retracting a movably supported furniture part into the closed end position relative to a furniture carcass. The device includes an entrainment member which can be releasably coupled to the movable furniture part and which is supported movably along an at least portion-wise linear displacement path, and at least one spring device for applying force to the entrainment member. The spring device can be stressed by way of a spring holder separate from the entrainment member.

In addition, the invention concerns a drawer extension guide and an article of furniture having a retraction device of the kind to be described.

Retraction devices of that kind (known, for example, from EP 0 391 221 B1 to the present applicant) are used in particular with drawers or sliding doors which are freely displaceable over a large part of their extension region and engaged by the entrainment member of the retraction device only towards the end of the closing movement, and are pulled securely and reliably into the closed end position by spring force. The movable furniture part is thus pulled into the furniture carcass automatically without further application of force by the user and is held there with a predetermined closing force. That last portion of the closing movement can be damped by an additional damping device so that a gentle closing process can be achieved without annoying impact sounds. Upon opening of the movable furniture part, the user firstly has to apply a force against the spring resistance of the retraction device, by pulling, until after a predetermined distance the entrainment member is uncoupled from the movable furniture part and is moved into a prestressed parking position in which the spring remains in a stressed readiness position so that in the next closing process the movable furniture part can be pulled in again. For a user, uncoupling of the entrainment member in the opening movement for the drawer frequently makes itself noticeable with a jerky movement as, as a consequence of the sudden spring separation force, the drawer is now freely movable and is accelerated unduly towards the user by virtue of the previously exerted pulling force.

Retraction devices in accordance with the classifying portion of claim 1 are described for example in WO 2009/132626 A1 and in EP 1 470 769 A1. In those structures, there are an entrainment member and a spring holder separate therefrom, in which case however the force of the spring device abruptly ceases when the entrainment member is parked into the prestressed parking position. Thus, the drawer is accelerated in the opening direction.

FIG. 15*a* and FIG. 15*b* diagrammatically show two different retraction devices 8 according to the state of the art. FIG. 15*a* shows a linearly displaceable slider 16 on which an entrainment member 12 is supported tiltably about an axis of rotation 15. The entrainment member 12 which is in the form of a tilting segment is supported displaceably along a linear displacement path 10 by way of two guide elements 13 and can be moved into a tilted position towards the end of the extension movement into a curved or angled portion 11 so that the coupling element 14 of the drawer 3*a* can be uncoupled. In FIG. 15*a* the spring device is articulated on the linearly displaceable slider 16 while in FIG. 15*b* the spring device 17 directly engages the tiltably mounted entrainment member 12.

FIG. 17 shows a further embodiment of a retraction device 8 according to the state of the art, the spring device 17 directly engaging the tiltably mounted entrainment member 12.

SUMMARY OF THE INVENTION

Therefore, the object of the invention is to propose a retraction device of the general kind set forth in the opening part of this specification, which particularly also in the opening process permits a harmonic movement of the movable furniture part.

According to the invention, that object is attained by the features described below. Further advantageous configurations of the invention are also described. Thus, it is therefore provided that the spring holder is movably supported at or on the entrainment member, and there is a coupling device for motional coupling between the entrainment member and the spring holder. Due to the coupling device, the articulation mounting point of the spring device on the spring holder falls back when the entrainment member is pulled out relative to the position of the moving entrainment member, and the movement of the articulation mounting point of the spring device on the spring holder is slower than the movement of the entrainment member. Due to the coupling device, the articulation mounting point of the spring device on the spring holder falls back when the entrainment member is pulled out relative to the position of the moving entrainment member before the entrainment member passes into a parking position in which it releases a coupling element connected to the movable furniture part. The spring holder is continuously but movably connected to the entrainment member.

In that way, the spring device is stressed less than corresponds to the displacement travel of the entrainment member so that before reaching the parking position the entrainment member can move gently and softly thereinto. In that respect, from the point of view of a user, on the one hand less force has to be applied to open the movable furniture part while on the other hand the transition upon uncoupling of the entrainment member occurs with less of a jerk.

In one embodiment, the travel distance made available for the spring holder is greater than the effective travel distance of the entrainment member. Thus, (in accordance with the physical formula work=force times distance) less manual force is also required for stressing the spring device. The provision of a longer stressing travel for the spring device means that the friction can also be reduced, so that less manual force is also necessary for opening the movable furniture part.

Due to the coupling device, upon movement of the movable furniture part, the relative position between the entrainment member and the articulation mounting point of the spring device on the spring holder is variable. The coupling device can, for example, convert a linear movement of the entrainment member into a pivotal movement of the spring holder or vice-versa. In that case, the coupling device can include the slider and the spring holder, wherein the slider and the spring holder can have mutually interengaging tooth arrangements. In a possible embodiment, a tooth arrangement can be arranged on a rolling region of the spring holder while the slider has a straight tooth arrangement.

The coupling device can have, for example, a step-down mechanism or a step-down transmission, whereby the speed of the entrainment member can be stepped down to a lower speed of the spring holder at least over a region of the stressing travel. In that case, the spring device is stressed less for each travel unit covered by the entrainment member. In that way, the forces required for stressing the entrainment member can be reduced. For that purpose, the coupling device can include at least one rack-gear arrangement and/or a lever mechanism—in particular with lever arms of differing lengths. The coupling device can also have a gear transmission or a step-down arrangement with cables or belts.

In another embodiment of the invention, the coupling device cooperates with at least one control curve, and the spring holder of the spring device is guided along the control curve. The presence of a control curve on which the spring holder of the spring device can run means that the beginning, the configuration and the end of the spring force acting on the entrainment member can be freely selected in the most widely varying design configurations.

The control curve can be provided at least portion-wise separately from the displacement path of the entrainment member or can portion-wise overlap therewith—in particular, in the last retraction region of the entrainment member.

In another embodiment of the invention, the control curve of the spring holder—particularly in the region of the last stressing travel to the end of the stressing travel—has a curved shape so that sudden cessation of the spring force when the entrainment member is moved into the prestressed parking position can be alleviated.

The control curve of the spring holder can extend at least portion-wise in non-parallel relationship with the linear displacement path of the entrainment member, and the control curve of the spring holder at least portion-wise has a linear shape or has a substantially completely linear configuration. It is therefore possible for the linear displacement path of the entrainment member and the control curve of the spring holder to form two straight lines which extend transversely to each other. Alternatively or additionally, it is possible for the control curve of the spring holder to have a curved shape at least portion-wise, preferably over at least a third of the length, and preferably in the region of the last stressing travel, so that conclusion of the force of the spring device takes place less abruptly.

The entrainment member is mounted movably—as is known per se—between a parking position in which the spring is stressed and an end position in which the spring is at least partially relieved of stress. The parking position of the entrainment member can be secured in force-locking and/or positively locking relationship, and transfer of the entrainment member into the parking position can also take place over a guide portion which is curved or angled away from the linear displacement path of the entrainment member. It is also possible to bring about parking of the entrainment member by eccentric coupling of the spring device, whereby the entrainment member can be urged into the parking position by the acting spring force. A further option provides that the entrainment member has at least one guide element by way of which the entrainment member can be guided along the linear displacement path and is movable into the parking position—preferably over a guide portion which is curved or angled away from the linear displacement path.

In an embodiment of the invention, the entrainment member can also be arranged on a displaceable slider. In that case, the entrainment member can be rigidly connected to the slider and, in particular, can also be formed integrally with the slider. It is also possible for the entrainment member to be connected movably, preferably tiltably, to the slider. An integral configuration of the entrainment member on the slider in the form of a resilient catch portion which can be releasably coupled to the drawer or to an extendable rail of a drawer extension guide is also possible.

The spring holder is mounted movably at or on the entrainment member itself—preferably along a guide on the entrainment member. The spring holder can have a two-part or also multi-part configuration. The spring holder can be at least portion-wise linearly movably supported and/or can perform a pivotal movement at least portion-wise, which is possible without any problem, for example, by the provision of a suitable control curve.

To damp the retraction movement, there can be a damping device by which a movement of the entrainment member can be damped. In that respect, the damping device can be in the form of a fluid damper. In that respect, numerous variants are available to the person skilled in the art. For example, a—preferably hydraulic—piston-cylinder unit or also a rotational damper with at least two damping components which are rotatable relative to each other in the damping stroke movement and between which is arranged a fluid damping medium which retards the relatively movement of the two damping components can be used.

The spring device can have a spring—in particular a coil spring—or can be formed by a spring pack comprising parallel springs which are all moved equally far when the entrainment member is pulled out.

The drawer extension guide according to the invention is characterized by a retraction device of the kind described. In that case, the drawer extension guide has a carcass rail to be fixed to a furniture carcass and at least one drawer rail which is movable relative thereto, and which towards the end of the closing movement is engaged by the entrainment member of the retraction device and can be pulled thereby into the completely closed position.

The article of furniture according to the invention is characterized by a drawer extension guide of the foregoing kind and/or by a movable furniture part which can be retracted into the closed end position relative to a furniture carcass by the retraction device according to the invention.

BRIEF DESCRIPTION OF THE DRAWINGS

Further details and advantages of the present invention are described by means of the specific description hereinafter. In the drawings.

DETAILED DESCRIPTION OF THE INVENTION

Figure 1A:
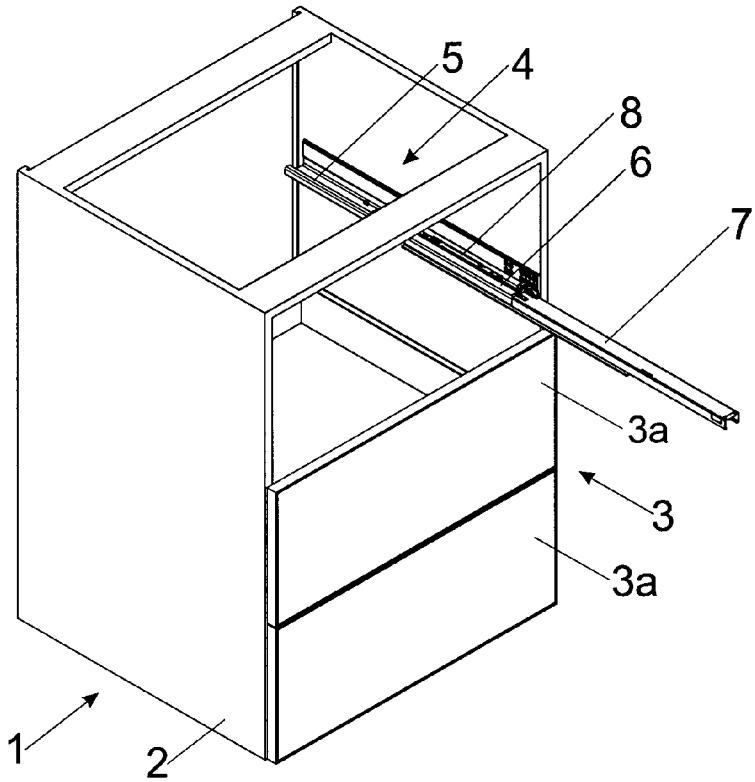
FIGS. 1*a*, 1*b* are perspective views of an article of furniture, wherein the retraction device is on the one hand part of a drawer extension guide and on the other hand is fixed as a separate component to a furniture carcass.
Figure 1B:
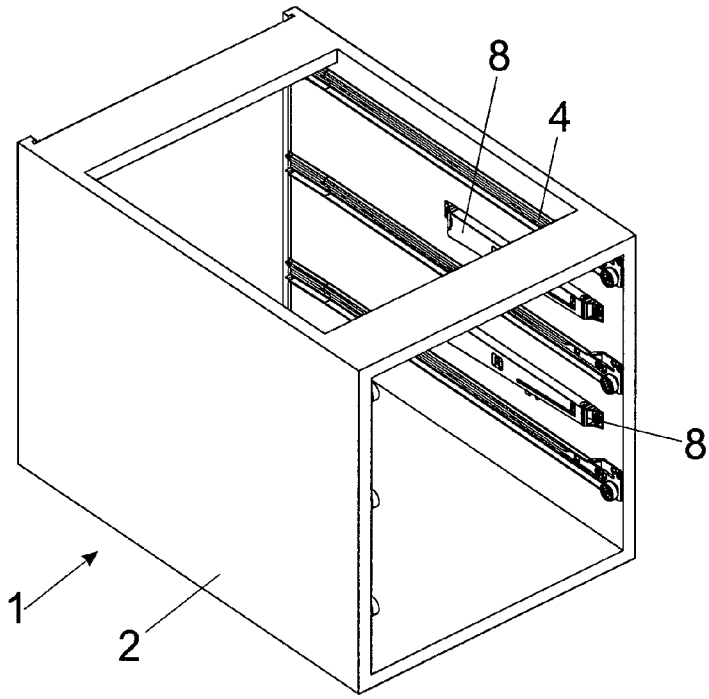

FIG. 1*a* is a perspective view of an embodiment of an article of furniture 1, wherein movable furniture parts 3 in the form of drawers 3*a* are supported displaceably relative to a furniture carcass 2 by way of drawer extension guides 4. The drawer extension guide 4 in a known manner has a carcass rail 5 to be fixed to the furniture carcass 2, and at least one drawer rail 7 displaceable relative to the carcass rail 5. A displaceable central rail 6 is supported between the carcass rail 5 and the drawer rail 7 in order to permit full extension of the drawer 3*a* relative to the furniture carcass 2. The drawer extension guide 4 has a retraction device 8 by which the central rail 6 or the drawer rail 7 (and therewith the drawer 3*a*) is engaged towards the end of the closing movement and can subsequently be pulled into the completely closed position.

In FIG. 1*a*, retraction devices 8 are pre-fitted to the furniture carcass 2 of the article of furniture 1, in a condition of being released from the extension guides 4. The extension guide 4 in the illustrated embodiment can be in the form of a so-called rolling pushing guide which itself does not have its own spring-assisted retraction device. The retraction device 8 can therefore also be fitted to the furniture carcass 2 in the form of a self-contained unit which is to be retro-fitted.

Figure 2:
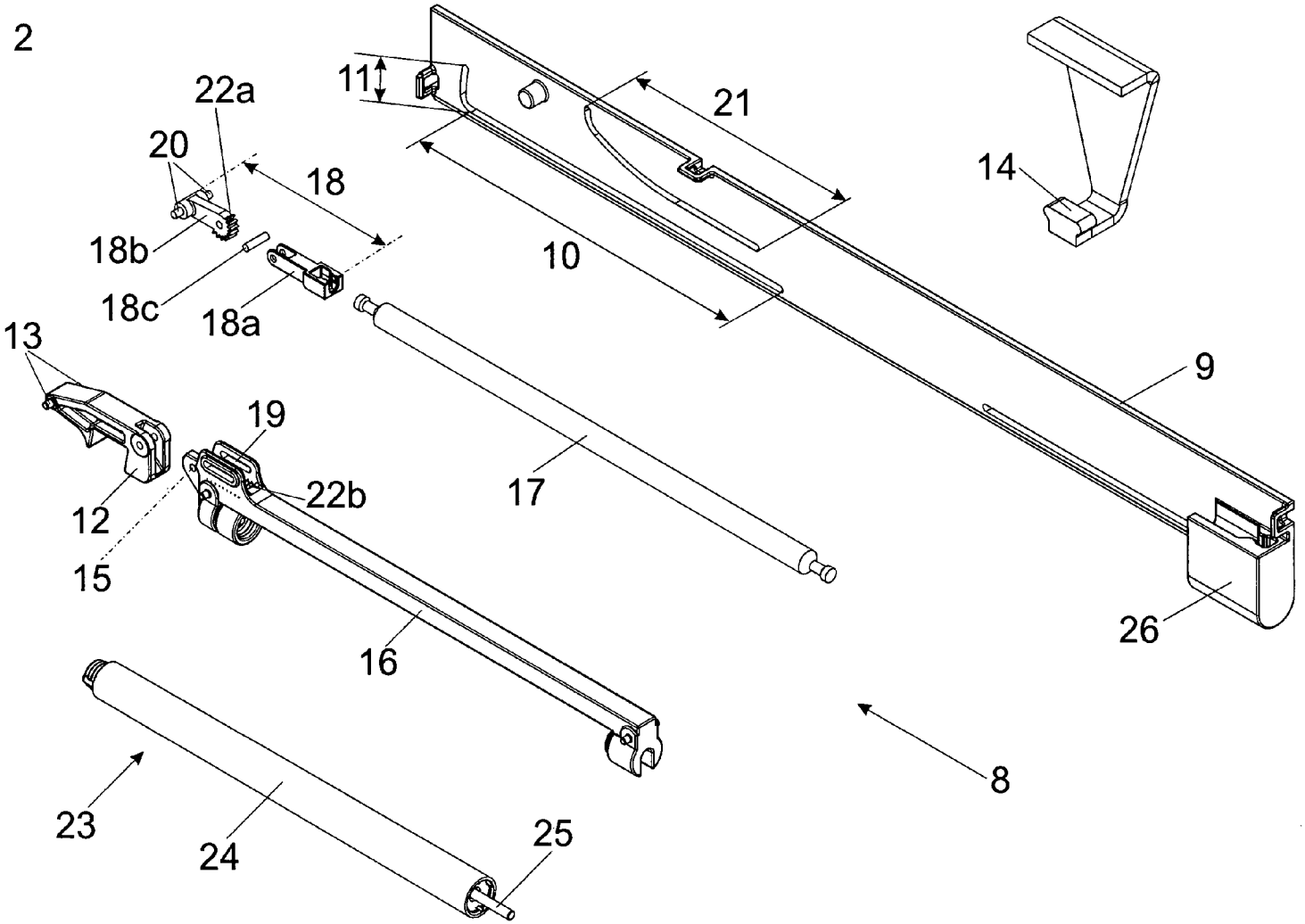
FIG. 2 is an exploded view of the retraction device.

FIG. 2 shows an exploded view of a possible embodiment of a retraction device 8. The retraction device 8 has a main body 9 which can be fixed either to the furniture carcass 2, to the drawer extension guide 4, or also to the drawer 3*a*. The main body 9 has a linear displacement path 10 and a guide portion 11 which is angled or curved away therefrom for guiding an entrainment member 12. The entrainment member 12 can have guide elements 13 which in the stressing process can firstly pass along the linear displacement path 10 and then into the curved or angled guide portion 11, in which case the entrainment member 12 can be releasably arrested in a pre-stressed parking position. The entrainment member 12 can be releasably coupled to a coupling element 14 which is connected either to the drawer 3*a*, to the central rail 8, to the drawer rail 7 or to the carcass rail 5 of the extension guide 4. The coupling element 14 is only shown by way of example, and can be in the form of a protruding projection which can be releasably coupled to the entrainment member 12. In the illustrated embodiment, the entrainment member 12 is connected tiltably about a—preferably horizontal—axis of rotation 15 to a slider 16 which is supported linearly displaceably relative to the main body 9. For applying force to the entrainment member 12, the arrangement has a spring device 17 by which the entrainment member 12 can be pulled into the completely closed position, starting from a parking position thereof (and thus the drawer 3*a*). The spring holder 18 for stressing the spring device 17 or for pulling in the entrainment member 12 has a multi-part structure in the illustrated embodiment, and includes a spring connection 18*a* as well as a tilting portion 18*b* which are pivotably connected together by an articulation mounting part (shaft) 18*c*. The articulation mounting part 18*c* of the spring device 17 is limitedly movably supported within a—for example slot-like—guide 19 of the slider 16. The tilting portion 18*b* has guide portions 20 which are mounted movably along a control curve 21 of the main body 9, that is separate from the linear displacement path 10. In the illustrated embodiment, the control curve 21 has a linear portion and a curved portion, wherein the spring device 17 can be stressed towards the end of the stressing travel over the curved portion of the control curve 21. It is also possible to see a coupling device having two cooperating tooth arrangements 22*a* and 22*b*, whereby the relative position of the spring holder 18 is variable relative to the linearly displaceable slider 16. In the illustrated Figure, the tilting portion 18*b* has a tooth arrangement 22*a* which can roll against a tooth arrangement 22*b* of the slider 16. The tooth arrangement 22*b* of the slider 16 can be in the form of a straight or linear tooth arrangement. To damp the closing movement of the entrainment member 12 (and thus to damp the last closing movement of the drawer 3*a*) there can be a damping device 23 which in the illustrated embodiment is in the form of a piston-cylinder unit, in which a piston with a piston rod 25 is arranged displaceably within the cylinder 24. The cylinder 24 is to be fixed to the slider 16 and the piston rod 25 is supported in the assembled condition against a counterpart abutment 26 of the main body 9. In the spring-assisted retraction movement of the entrainment member 12, the cylinder 24 is displaced relative to the stationary piston rod 25, wherein that retraction movement can be damped by fluid damping and/or by frictional damping.

Figure 3:
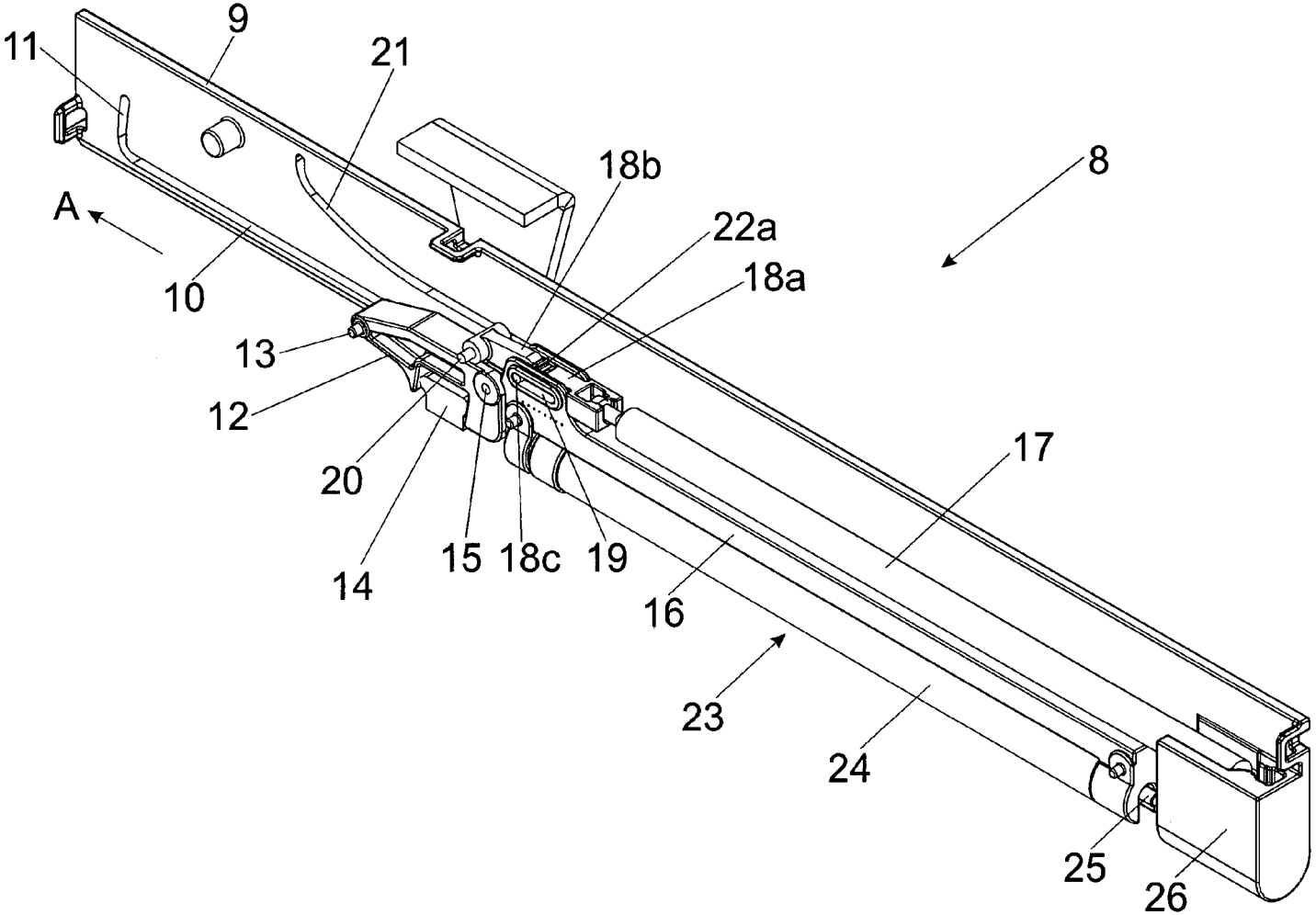
FIG. 3 shows the retraction device in the assembled condition, the entrainment member being in engagement with a coupling element of the drawer.

FIG. 3 shows a perspective view of the retraction device 8 in the assembled condition, a cover which covers the retraction device 8 not being shown for the sake of clarity of the drawing. The entrainment member 12 of the retraction device 8, that is mounted tiltably about the axis of rotation 15, is in the completely retracted position and, in that case, is in engagement with the coupling element 14 of the drawer 3*a*. By pulling on the drawer 3*a*, the entrainment member 12 is pulled by way of the guide elements 13 along the linear displacement path 10 in the extension direction (A) while the tilting portion 18*b* of the spring holder 18 is moved by way of the guide portions 20 along the separate control curve 21, whereby the spring device 17 is stressed. It is possible to see the tilting portion 18*b* which has the tooth arrangement 22*a* and which is pivotably connected to the spring connection 18*a* by way of the articulation mounting part 18*c*. The cylinder 24 of the damping device 23 is also moved with the linearly displaceable slider 16, in the extension movement, wherein the piston rod 25 is constantly supported against the counterpart abutment 26 of the main body 9.

Figure 4A:
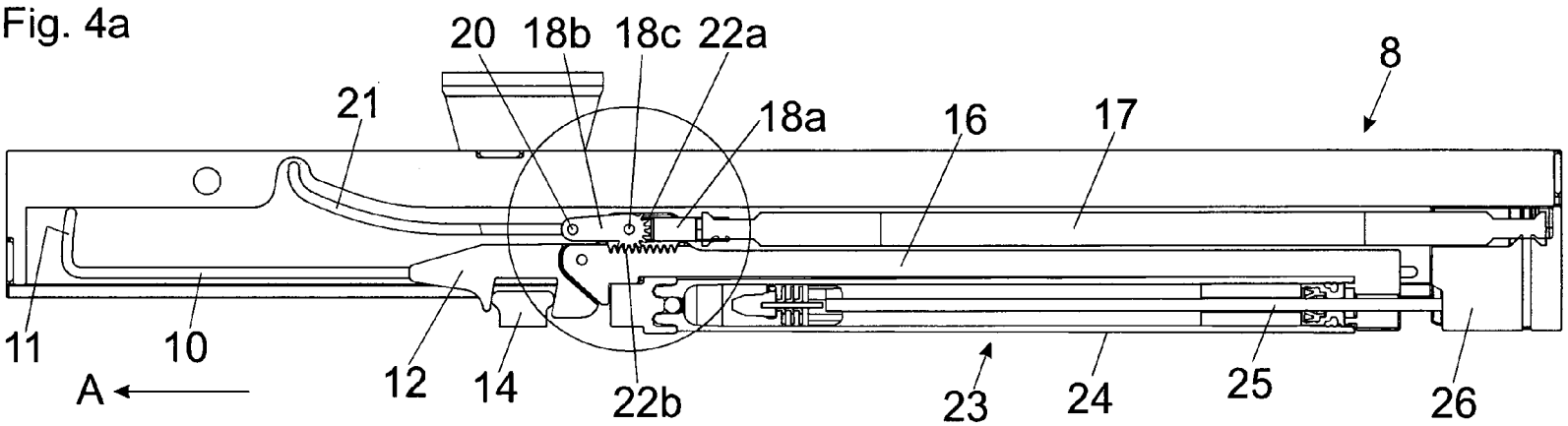
FIGS. 4*a*, 4*b* are a side view of the retraction device in the completely retracted closed position of the entrainment member, and an enlarged detail view in relation thereto.
Figure 4B:
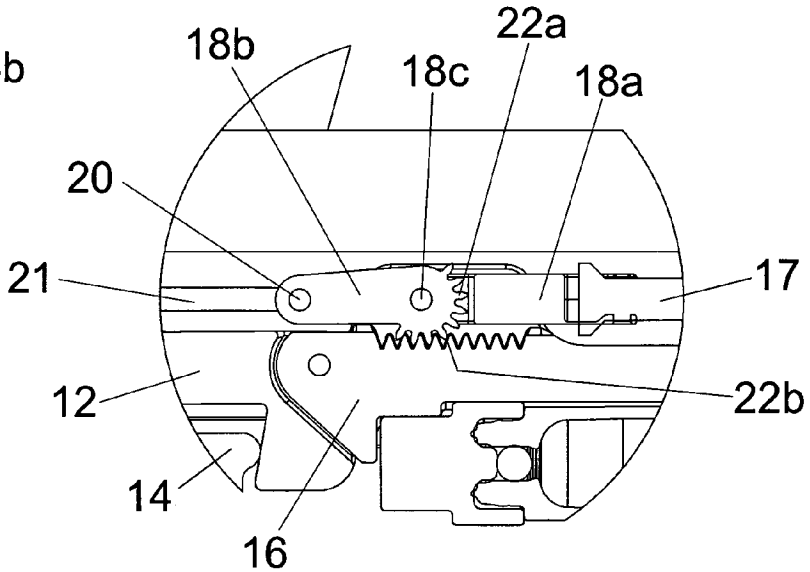

FIG. 4*a* shows a side view of the retraction device 8, wherein the entrainment member 12 is coupled to the coupling element 14 of the drawer 3*a* and is in the completely retracted closure position. FIG. 4*b* shows a view on an enlarged scale of the region circled in FIG. 4*a*. If now the drawer 3*a* is pulled out of the completely closed position, the entrainment member 12 is also moved in the extension (opening) direction A against the force of the spring device 17. The entrainment member 12 can be moved along the linear displacement path 10 by the guide element 13 shown in FIG. 2, while the tilting portion 18*b* of the spring holder 18 can be guided by the guide portion 20 along the preferably curved control curve 21.

Figure 5A:
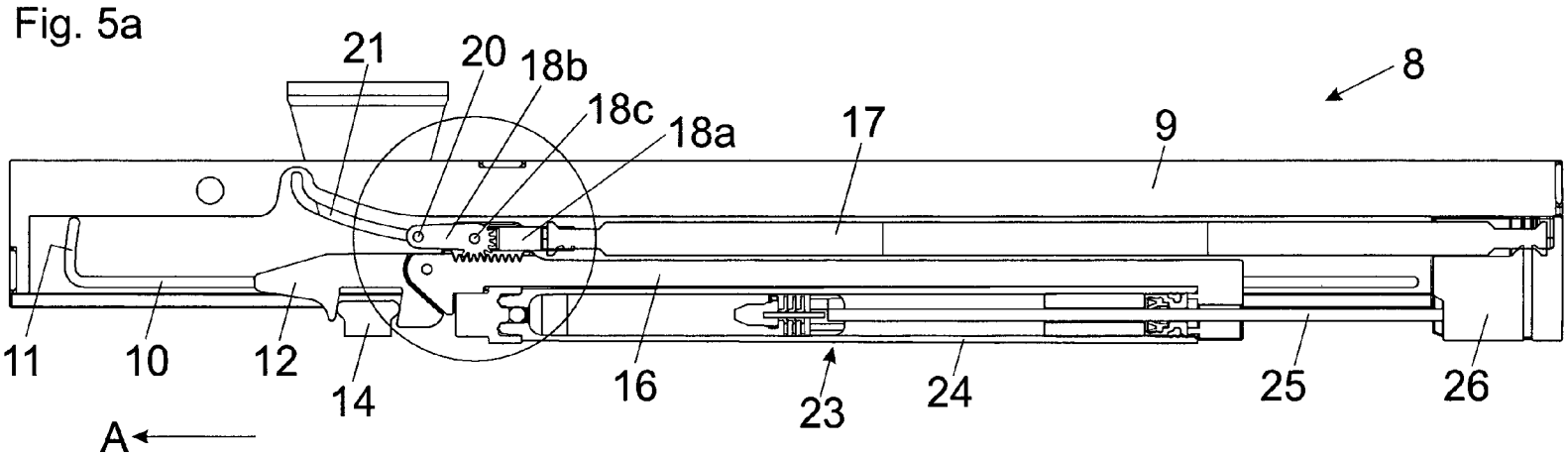
FIGS. 5*a*, 5*b* show a position of the entrainment member which is extended further in relation to FIGS. 5*a* and 5*b* and an enlarged detail view thereof.
Figure 5B:
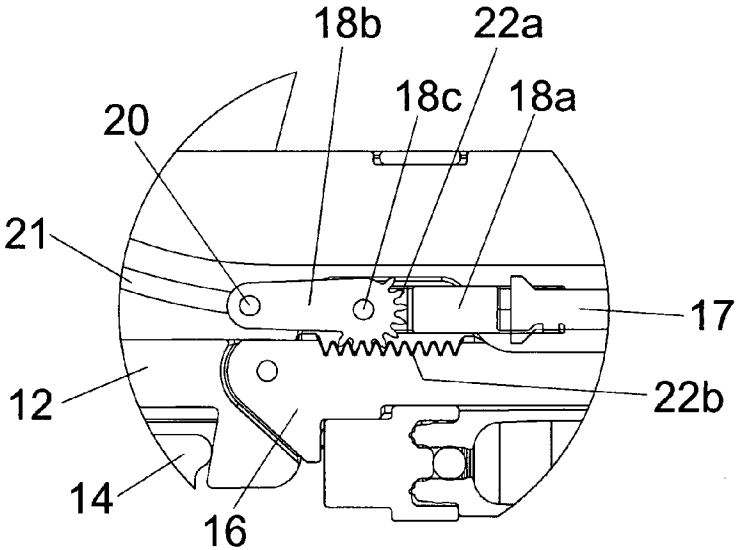

FIG. 5*a* shows a slightly open position of the entrainment member 12, which has been pulled out further in relation to FIGS. 4*a* and 4*b*. FIG. 5*b* shows an enlarged detail view of the region circled in FIG. 5*a*. At the beginning of that extension movement in the extension direction (A), the tooth arrangement 22*a* of the tilting portion 18*b* does not roll against the tooth arrangement 22*b* of the slider 16, whereby therefore the travel distance covered by the slider 16 substantially corresponds to the travel distance covered by the spring holder 18. Initially, therefore, this involves identical motional relationships between the slider 16 and the spring holder 18. In this process, the cylinder 24 of the damping device 23 is also moved so that the piston rod 25 is pulled out of the cylinder 24. The piston rod 25 can be supported against the counterpart abutment 26 of the main body 9, for example, by the force of a return spring supported in the cylinder 24. It will be appreciated that the piston rod 25 can also be fixedly connected to the counterpart abutment 26.

Figure 6A:
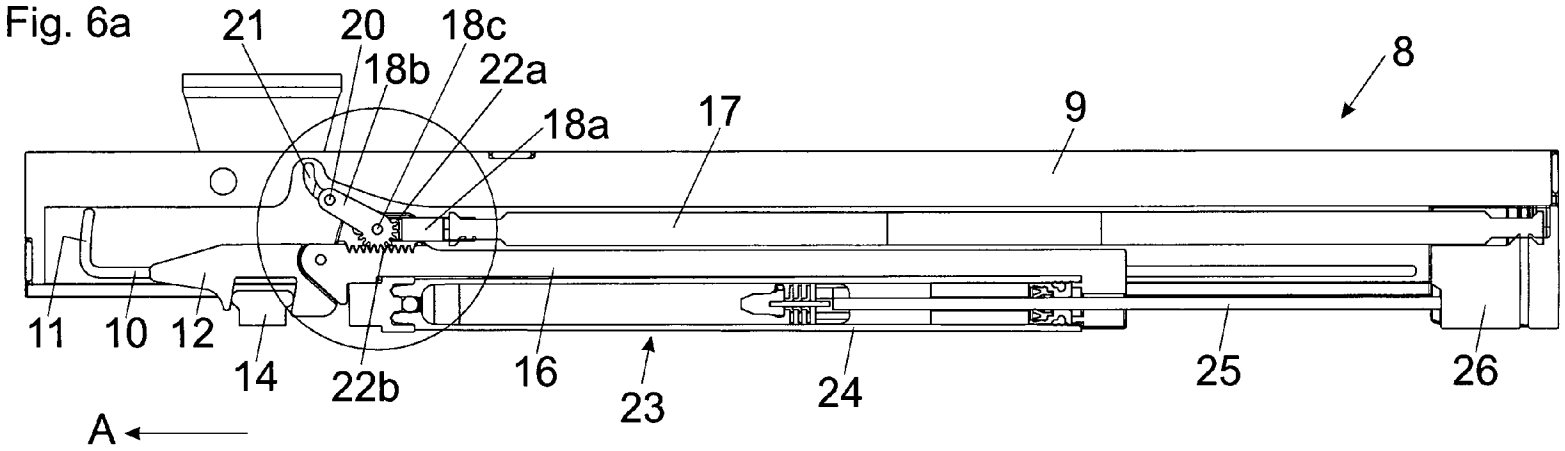
FIG. 6*a*, 6*b* show a further open position of the entrainment member and an enlarged detail view in respect thereof, wherein from that moment in time the movement of the spring holder is continued with a differing movement characteristic.
Figure 6B:
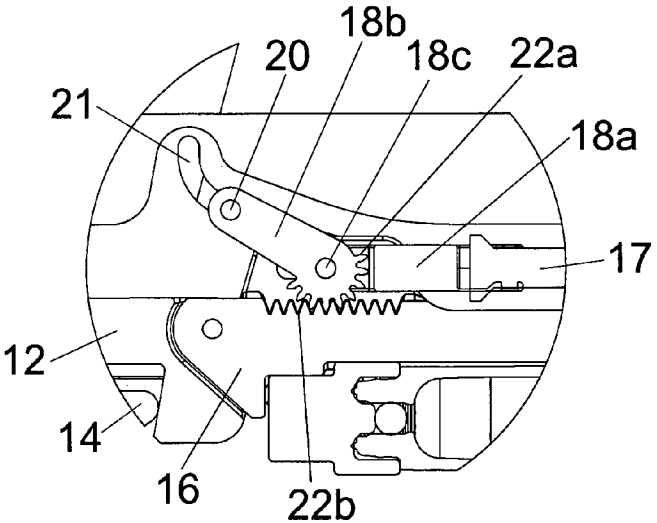

FIG. 6*a* shows a further open position of the entrainment member 12, which is extended further as compared to FIGS. 5*a* and 5*b*, wherein the function of the coupling device—which in the illustrated embodiment includes the slider 16 with its tooth arrangement 22*b* and the tilting portion 18*b* with its tooth arrangement 22*a*—is explained. As from a predetermined relative position of the tilting portion 18*b* with respect to the slider 16, the tooth arrangement 22*a* of the tilting portion 18*b*, arranged on the rolling region, can roll against the straight tooth arrangement 22*b* of the slider 16, whereby the tilting portion 18*b* is pivotable relative to the slider 16, namely about the coupling element 20 which is supported in the control curve 21 and which in this case forms an axis of rotation (along with articulation mounting part 12*c*). If now the drawer 3*a* is further pulled, that movement is continued with different motional relationships to the spring connection 18*a*, whereby therefore the spring device 17 is less stressed per unit of travel covered by the entrainment member 12. In that way, the forces required for stressing the spring device 17 can be reduced. FIG. 6*b* shows an enlarged view of the region circled in FIG. 6*a*.

Figure 7A:
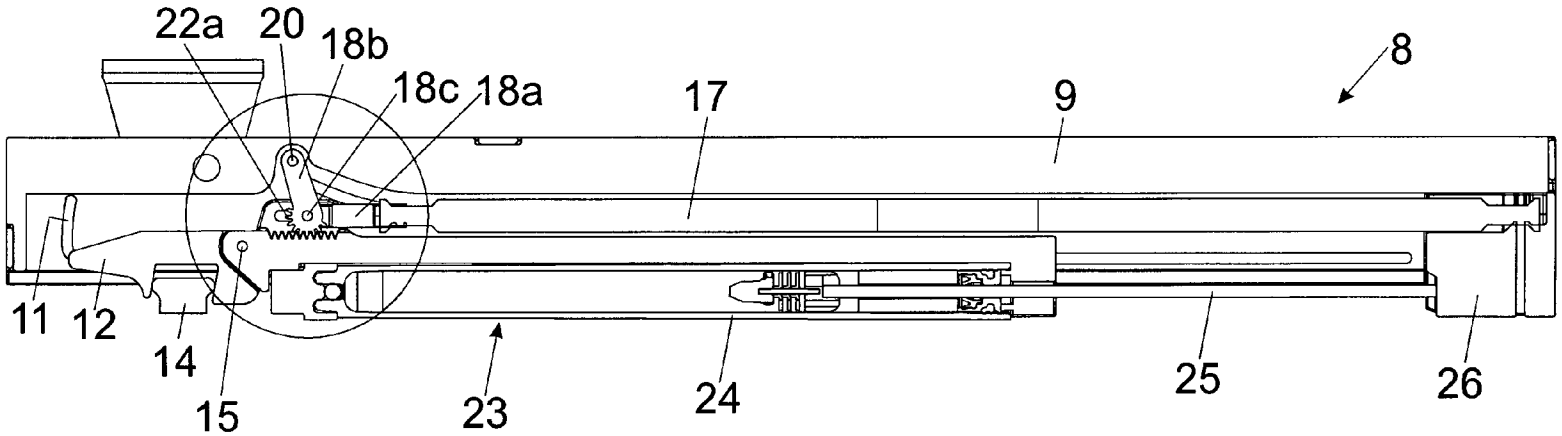
FIGS. 7*a*, 7*b* show an opening movement which is continued in relation to FIGS. 6*a* and 6*b*, wherein the entrainment member is near the parking position, and an enlarged detail view thereof.
Figure 7B:
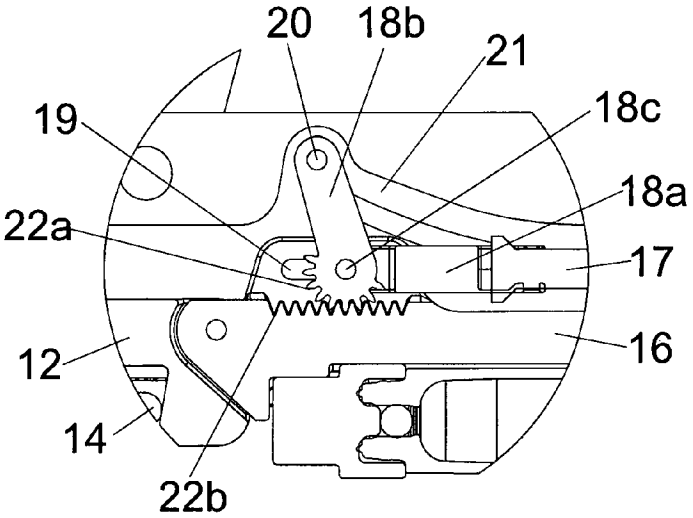

FIG. 7*a* shows the position of the entrainment member 12 which has now reached the end of the linear displacement path 10 in the stressing operation. In the illustrated embodiment, the entrainment member 12, at its tip, has a guide element 13 (FIG. 3) whereby, in a continued opening movement, the entrainment member 12 can be tilted about the axis of rotation 15 relative to the slider 16. In that arrangement, the guide element 13 of the entrainment member 12 can pass into the curved or angled guide portion 11, whereby the entrainment member 12 and the spring device 17 which is now stressed can be arrested in that parking position. It should obviously be noted that the person skilled in the art can also find further embodiments by way of example for tilting movement of the entrainment member 12 without being inventively active in that respect. FIG. 7*b* shows an enlarged view of the region circled in FIG. 7*a*.

Figure 8A:
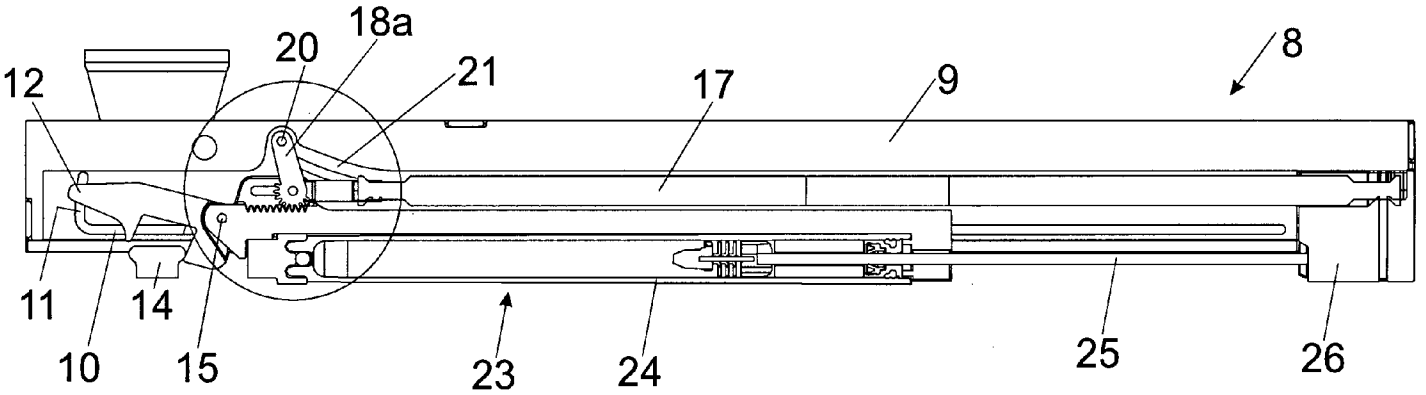
FIGS. 8*a*, 8*b* show the retraction device with the entrainment member arrested in the parking position and a view in which the coupling element is completely uncoupled from the entrainment member.
Figure 8B:
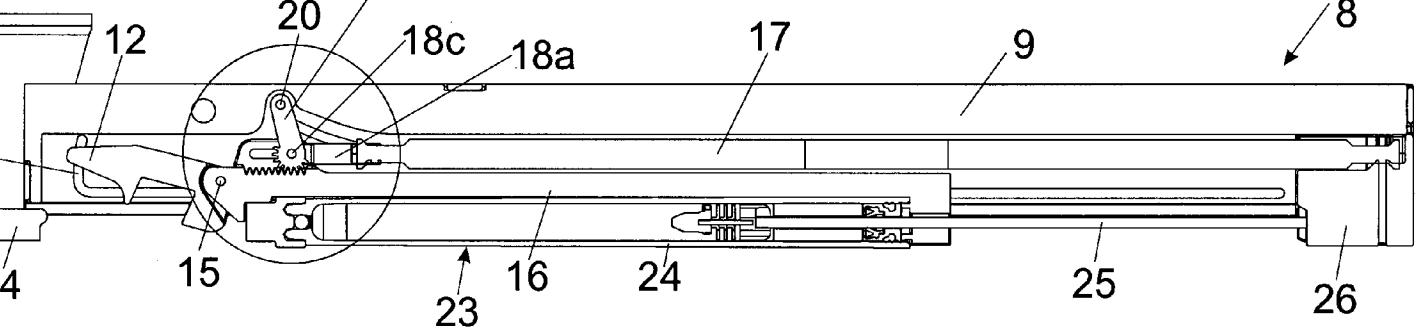

FIG. 8*a* now shows the entrainment member 12 which has been tilted into the parking position and arrested, wherein the coupling element 14 is released by a tilting movement of the entrainment member 12, and so the drawer 3*a* is freely displaceable over the remaining extension travel path. The coupling element 14 which is completely uncoupled from the entrainment member 12 is shown in FIG. 8*b*. The entrainment member 12 now remains in that parking position until the drawer 3*a* is pushed in again and thus the coupling element 14 again approaches the entrainment member 12. Towards the end of the closing movement, the coupling element 14 can pass into the notch of the entrainment member 12, whereby the latter tilts out of the arrested parking position again and is pulled into the completely closed position along the linear displacement path 10 by the force of the previously loaded spring device 17. That retraction movement can be damped by a damping device 23. In the illustrated embodiment, the cylinder 24 supported on the slider 16 is pushed in relative to the stationary piston rod 25, in which case a braking effect can be generated in particular by a fluid in the cylinder 24. The stressing process upon opening the drawer 3*a* can then begin afresh again, as is shown in FIGS. 4*a* through 8*b*.

Figure 9A:
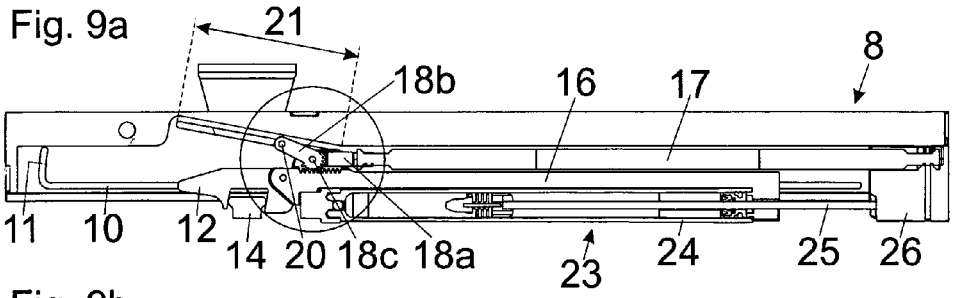
FIGS. 9*a*-9*e* show an alternative embodiment of the retraction device, the spring holder being guided along a linear control curve.
Figure 9B:
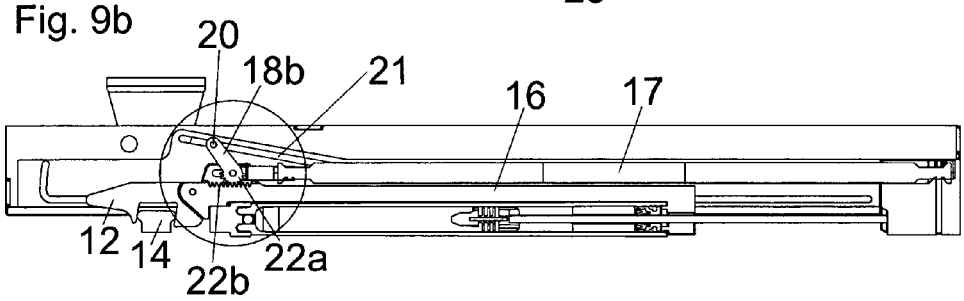
Figure 9C:
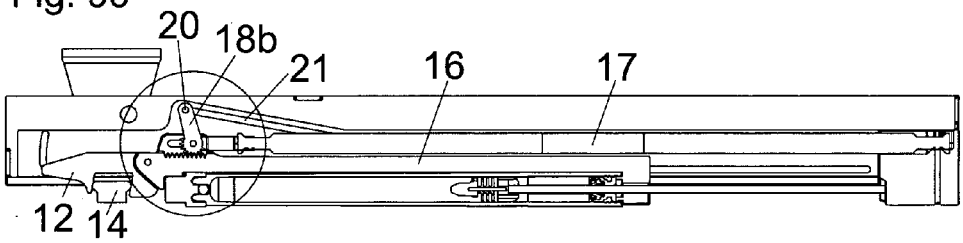
Figure 9D:
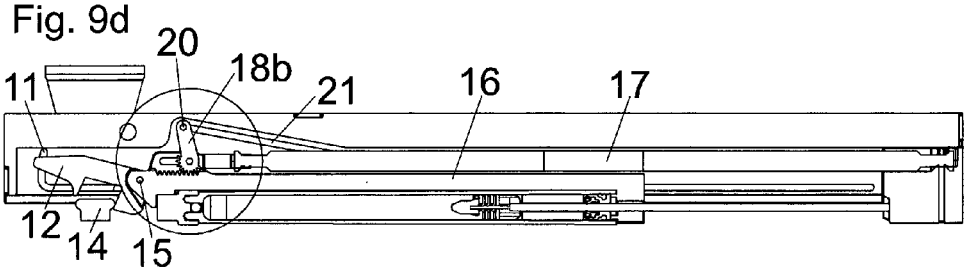
Figure 9E:
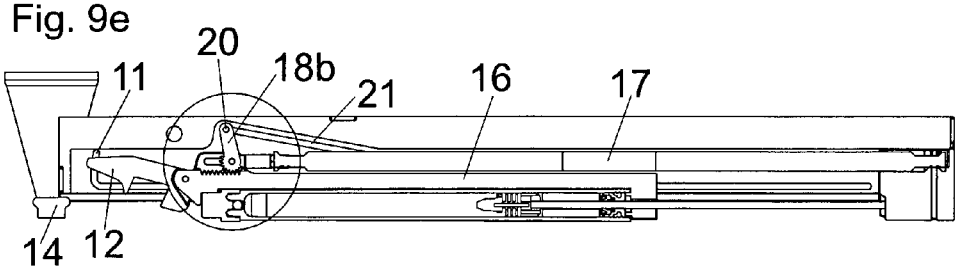

FIGS. 9*a*-9*e* show an alternative embodiment with a linearly extending control curve 21 in time sequences of the stressing process. FIG. 9*a* shows a side view of the retraction device 8, wherein the retraction device 8 can also have all components of the preceding Figures, with the same references denoting the same parts. The difference in relation to the preceding Figures is therefore that the control curve 21 for guiding the spring holder 18 (spring connection 18*a* and tilting portion 18*b* which are pivotably connected together by way of the articulation mounting point 18*c* which is in the form of an axis pin) extends—preferably exclusively—linearly. The tilting portion 18*b* has at least one guide portion 20 by which the tilting portion 18*b* is guided along the control curve 21. FIG. 9*a* shows the retraction device 8 in the closed position. A pulling movement is applied to the entrainment member 12 by manually pulling on the drawer 3*a* (FIG. 1*a*) by way of the coupling element 14. In that case, the tooth arrangement 22*a* of the tilting portion 18*b* runs against the tooth arrangement 22*b* of the slider 16 (FIG. 9*b*). When a further pulling movement is applied to the drawer 3*a*, the guide portion 20 passes to the end of the control curve 21 (FIG. 9*c*), wherein the guide portion 20 as from that position forms a pivot axis for the tilting portion 18*b*. It will be seen from FIG. 9*d* that the entrainment member 12 can pass into the curved or angled portion 11 by way of the guide element 13 arranged on the entrainment member (for example FIG. 3), in which case the entrainment member 12 is tiltable relative to the slider 16 by way of a pivot axis 15 and in that case releases the coupling element 14 connected to the drawer 3 so that the drawer 3*a* is freely displaceable over the remaining extension travel. In FIGS. 9*d* and 9*e* therefore the entrainment member 12 is arrested in a pre-stressed parking position—preferably by way of the guide element 13 shown in FIG. 3. In the next closing movement of the drawer 3*a* the coupling element 14 moves closer to the entrainment member 12, and guides it out of the pre-stressed parking position whereby the coupling element 14 (and therewith the drawer 3*a*) can be pulled into the closed end position by the previously stressed spring device 17, wherein that retraction movement can be damped by the damping device 23 shown in FIG. 9*a*. The spring holder 18 can be guided over a longer stressing travel by way of the control curve 21 whereby less manual force is also required for stressing the spring device 17.

Figure 10:
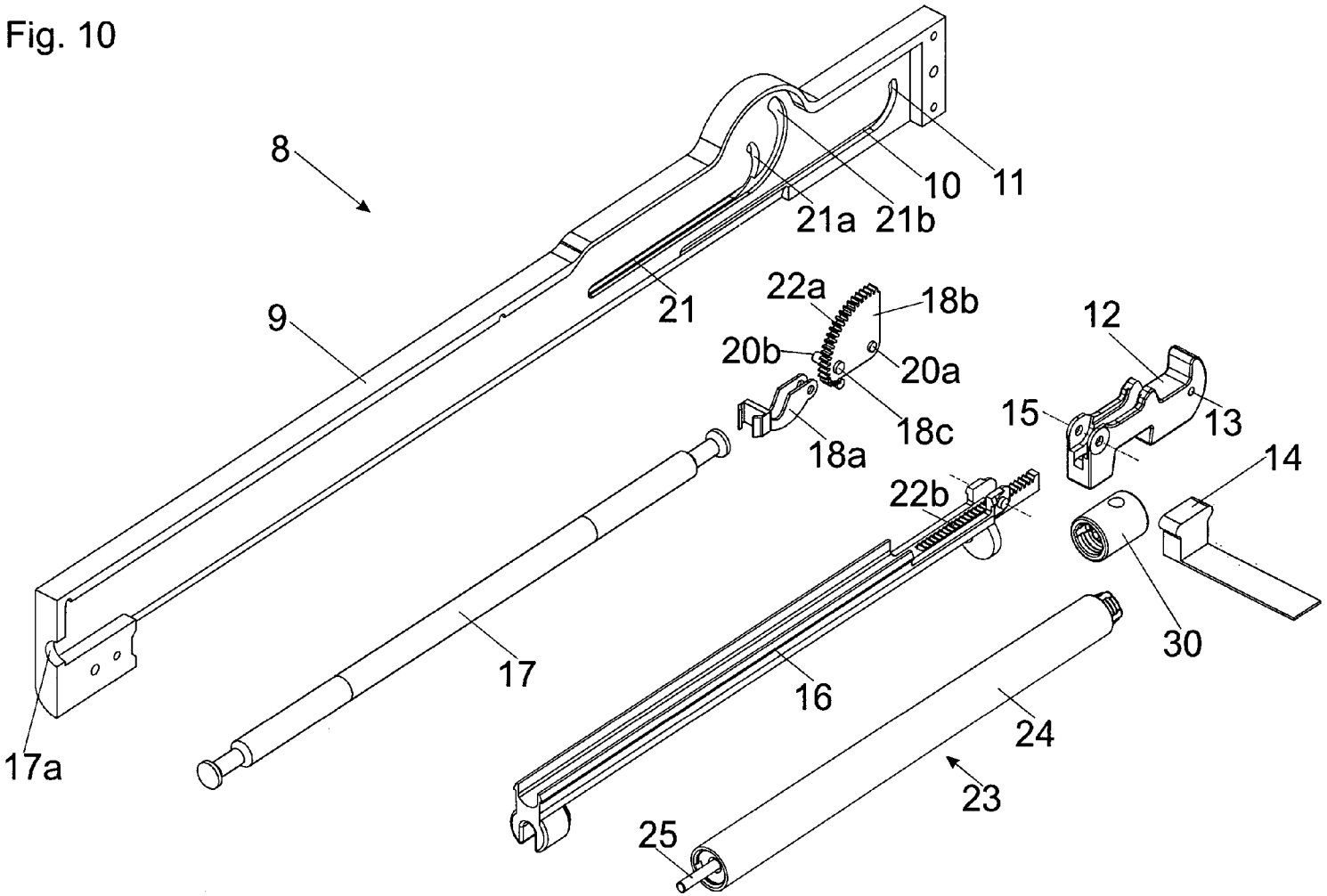
FIG. 10 is an exploded view of a retraction device according to a further embodiment.

FIG. 10 shows an exploded view of a retraction device 8 of a further embodiment. Provided on or in the main body 9 is a control curve 21 which has two guide portions 21*a* and 21*b* for guiding the tilting portion 18*b* and/or for locking the entrainment member 12. In addition, arranged on the main body 9 are the linear displacement path 10 and the curved or angled portion 11 adjoining same, for guiding the entrainment member 12. The entrainment member 12 can be guided by way of a guide element 13 along the displacement path 10 and along the angled or curved portion 11. The spring device 17 can be stationarily fixed on the one hand to a mounting point 17*a* of the main body 9 while on the other hand the spring device 17 is coupled to the spring connection 18*a*. The spring connection 18*a* is connected movably by way of the articulation mounting point 18*c* to a tilting portion 18*b*. The tilting portion 18*b* has an arcuate tooth arrangement 22*a* which in the mounted position is in engagement with a corresponding tooth arrangement 22*b* of the slider 16. Arranged on the tilting portion 18*b* is a first guide part 20*a* which can pass into the guide portion 21*a* of the control curve 21—but not into the guide portion 21*b* of the control curve 21. In addition, the tilting portion 18*b* has a second guide part 20*b* which can pass into the guide portion 21*b* but not into the guide portion 21*a* of the control curve 21. That kind of guidance is made possible by pin-shaped guide parts 20*a* and 20*b* which can be of a differing diameter and/or a differing length. In addition, the guide portions 21*a* and 21*b* of the control curve 21 can also be of a different passage width and/or a different passage depth. The entrainment member 12 is connected to the slider 16 pivotably—preferably by way of a horizontal axis of rotation 15. Supported on the slider 16 is a damping device 23 having a piston-cylinder unit 24, 25 by which the retraction movement of the entrainment member 12 (and therewith the drawer 3*a*) can be damped.

Figures 11A, 11B:
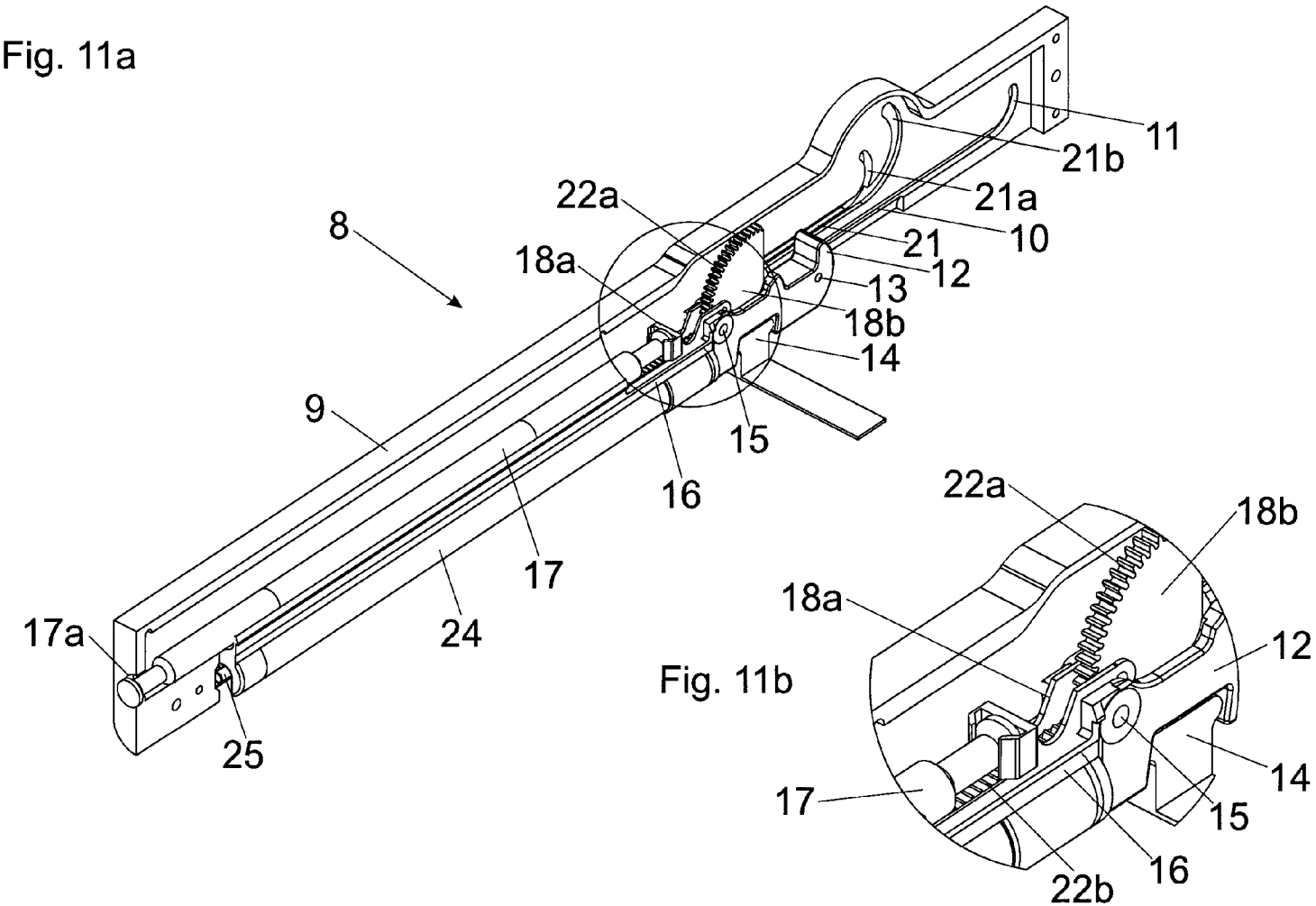
FIGS. 11*a*, 11*b* are a perspective view of the retraction device of FIG. 10, and an enlarged detail view thereof.

FIG. 11*a* shows a perspective view of the retraction device 8 shown in FIG. 10. In FIG. 11 *b*, in contrast, the region circled in FIG. 11*a* is shown as an enlarged view. In the illustrated Figure, the retraction device 8 is in the completely retracted closed position. If now a pulling force is applied to the drawer 3*a* in the closed position, the entrainment member 12 can be moved along the linear displacement path 10. At the beginning of that extension movement, the tooth arrangement 22*a* of the tilting portion 18 can still remain in its relative position with respect to the tooth arrangement 22*b* of the slider.

Figure 12A:
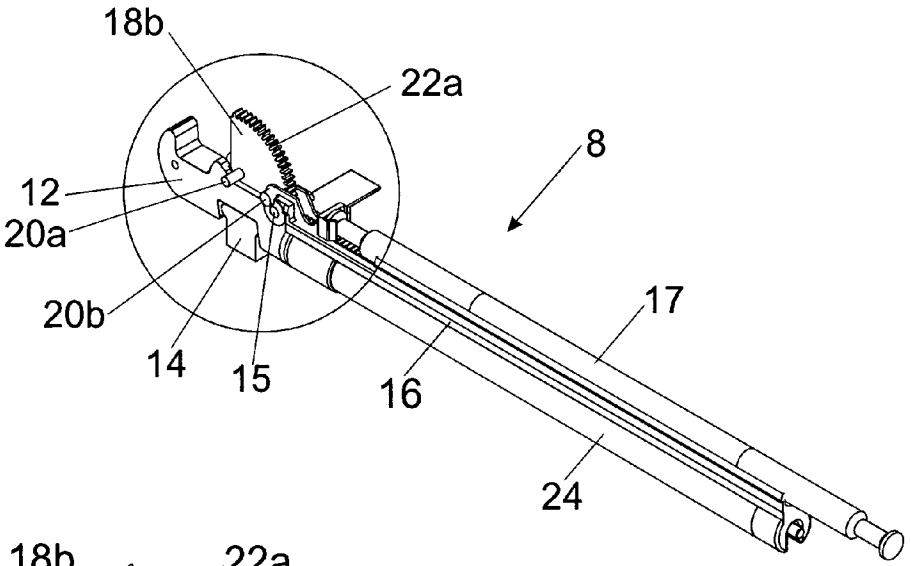
FIGS. 12-12*c* are various views of the retraction device of FIGS. 10, 11*a* and 11*b*, FIGS. 13*a*-13*e* show time sequences of the stressing process for the spring device in an embodiment of the retraction device shown in FIGS. 10 through 12.
Figure 12B:
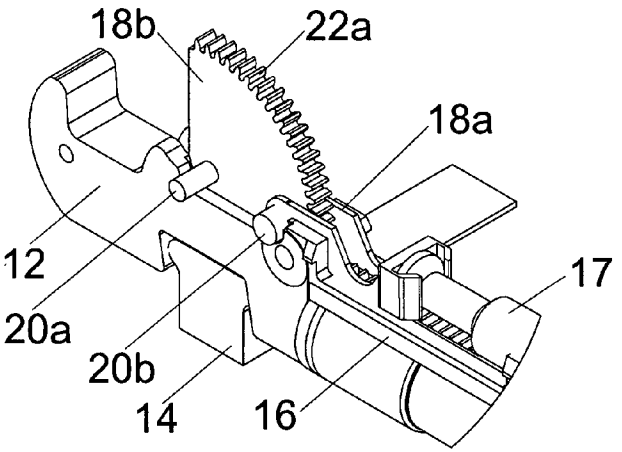
Figure 12C:
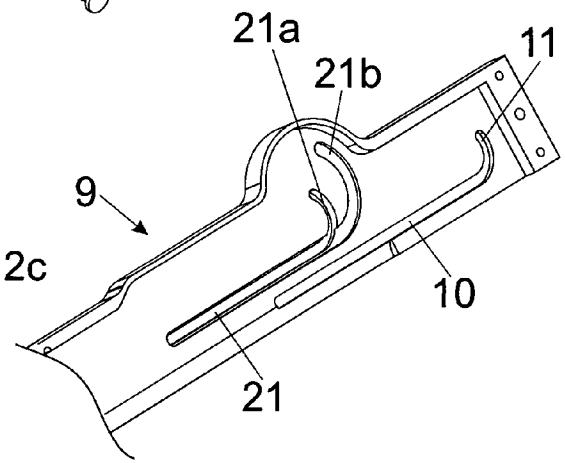

FIG. 12*a* shows a perspective view of the rear side of the retraction device 8. It is possible to see the two guide parts 20*a* and 20*b* of the tilting portion 18*b* which—as can be clearly seen from the enlarged detail view in FIG. 12*b*—can be of a different diameter and a different length. It is possible to see in FIG. 12*c* a part of the main body 9 having the control curve 21 and the two guide portions 21*a* and 21*b* branching therefrom. The guide portions 21*a* and 21*b* have different passage widths and they are provided to receive the respective guide parts 20*a* and 20*b*. That construction can provide that the guide part 20*a* can only pass into the guide portion 21*a* upon stressing of the spring device 17, while in contrast the guide part 20*b* can only pass into the guide portion 21*b* of the control curve 21.

Figure 13A:
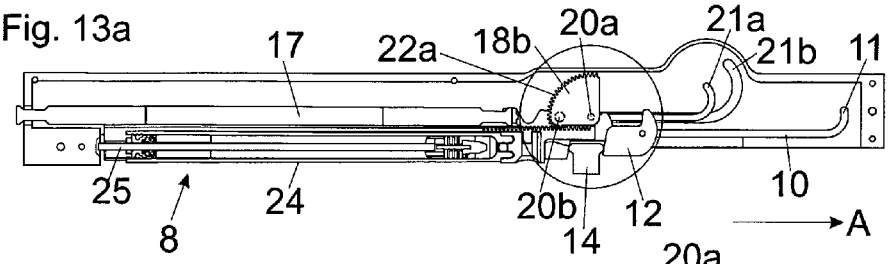
Figure 13B:
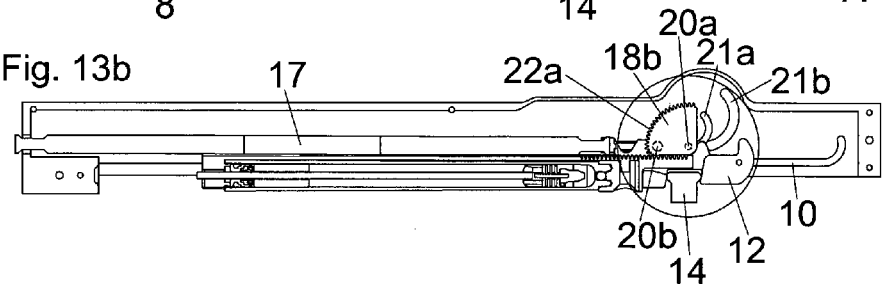
Figure 13C:
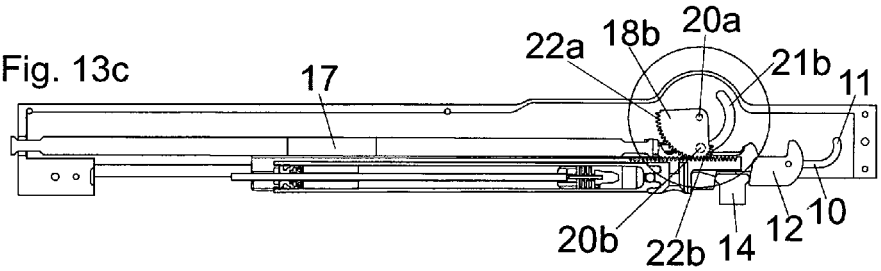
Figure 13D:
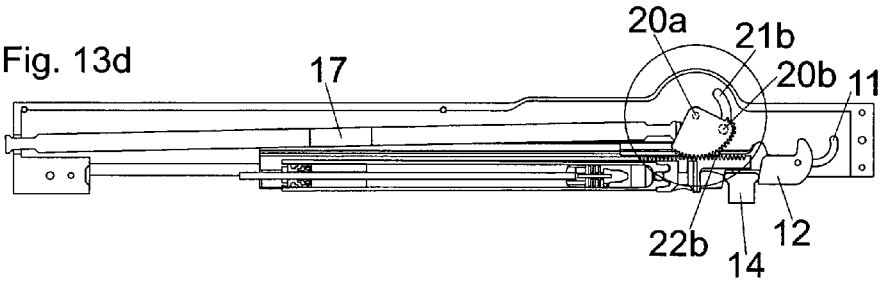
Figure 13E:
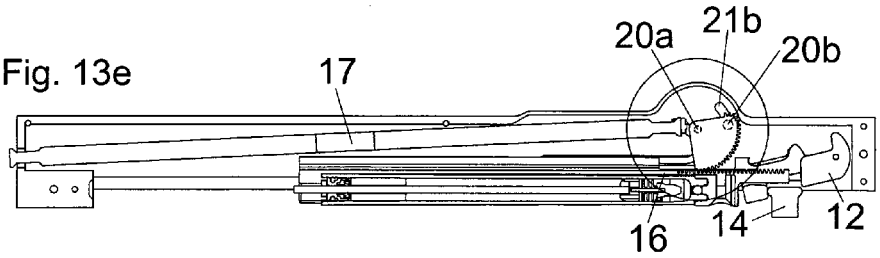

FIGS. 13*a*-13*e* show time sequences of the stressing process for the spring device 17. In FIG. 13*a* the drawer 3*a* is in the completely closed position. By pulling on the drawer 3*a* the coupling element 14 is also moved whereby the entrainment member 12 is also pulled in the extension (open) direction (A) along the linear displacement path 10 and the spring device 17 is stressed. The two guide parts 20*a* and 20*b* of the tilting portion 18*b* are disposed within the linear portion of the control curve 21, while the tooth arrangement 22*a* of the tilting portion 18*b* is connected to the tooth arrangement 22*b* of the slider 16. If now the drawer 3*a* is further pulled, then the guide part 20*a* passes into the guide portion 21*a* (FIG. 13*b*) whereupon the tilting portion 18*b* is pivoted and the guide part 20*a* butts against the end of the guide portion 21*a*. The guide part 20*b* which is of the larger diameter can now pass into the wider guide portion 21*b* of the control curve 21 (FIG. 13*c*), wherein the tooth arrangement 22*a* of the tilting portion 18*b* and the tooth arrangement 22*b* of the slider 16 can move relative to each other whereby the tilting portion 18 is pivoted in the counter-clockwise direction (FIG. 13*d*). In FIG. 13*e* the entrainment member 12 has moved into the curved or angled portion 11, wherein the entrainment member 12 was pivoted relative to the slider 16 so that the coupling element 14 of the drawer 3*a* is released and the drawer 3*a* is freely displaceable over the remaining extension travel. Just before the tilting movement of the entrainment member 12, therefore, the force is transmitted to the tilting portion 18*a*, wherein the entrainment member 12 per se is no longer substantially subjected to any more pulling force as the entrainment member 12 can be arrested in the readiness position by way of the tilting portion 18*b* and by way of the guide parts 20*a*, 20*b* which are disposed in the guide portions 21*a* and 21*b*.

Figure 14:
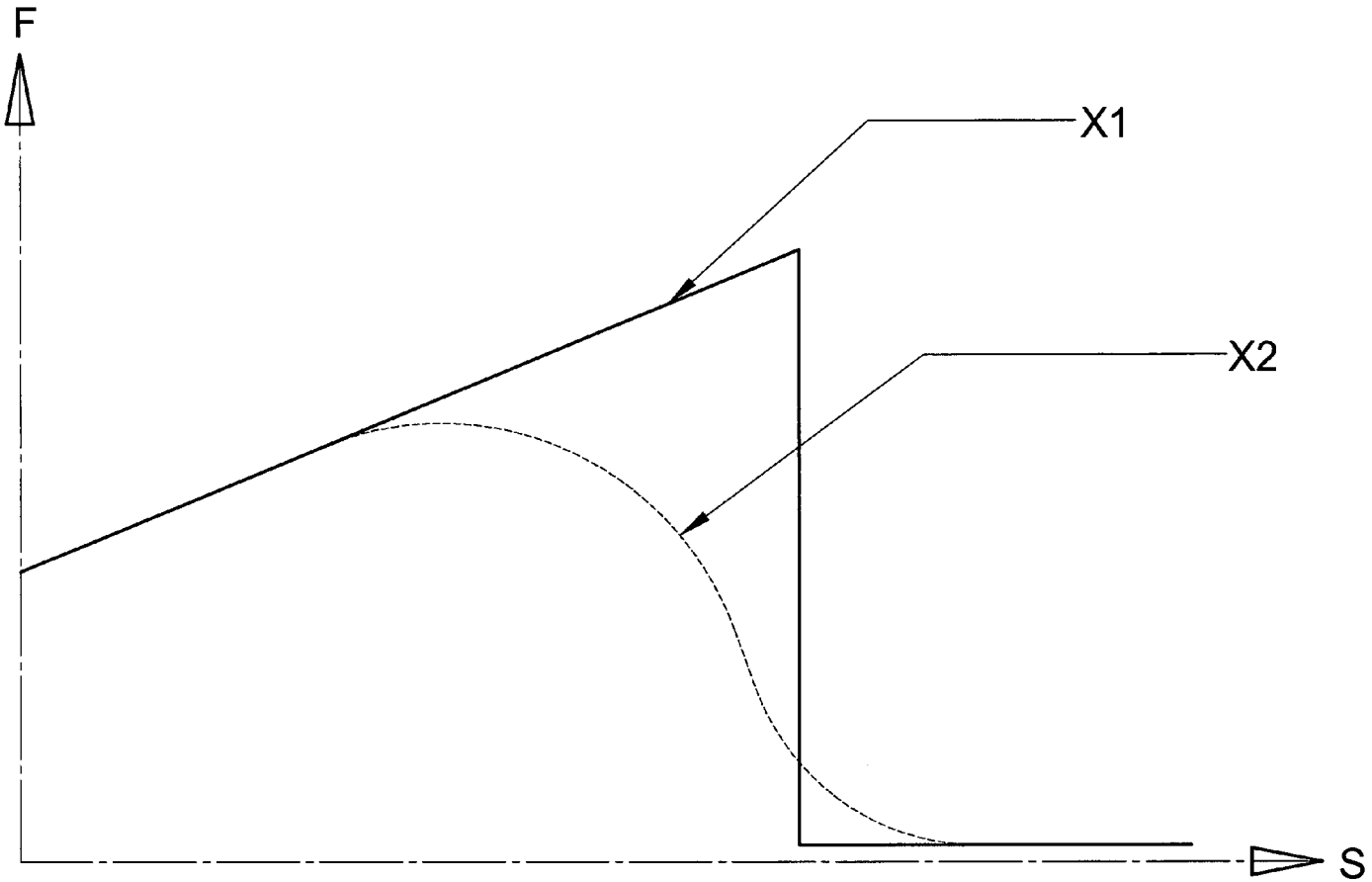
FIG. 14 shows a graph comparison of the configuration of the opening force in a retraction device according to the state of the art and a possible configuration of the opening force according to the invention plotted against the extension travel of the movable furniture part.

FIG. 14 diagrammatically shows a graphic comparison of the opening force variation X1 in the case of a retraction device according to the state of the art and an opening force variation X2 by way of example according to the invention plotted in relation to the extension travel S of the drawer 3*a*. In the case of the opening force variation X1 in the state of the art, the drawer 3*a* which is in the closed position is pulled, in which case the force required to open the drawer 3*a* firstly rises linearly until parking of the entrainment member 12 causes an abrupt drop in the force F. That drop in force F makes itself apparent to a user by an (unwanted) acceleration of the drawer 3*a* in the opening direction. In the case of the opening force variation X2 according to the invention, the force required to open the drawer 3*a* initially also rises but that force then continuously drops, whereby it is possible to bring about a harmonic motion characteristic for the opening process. It will also be clear from the opening force variation X2 that the force required to open the drawer 3*a* is reduced in relation to the opening force variation X1.

Figure 15A:
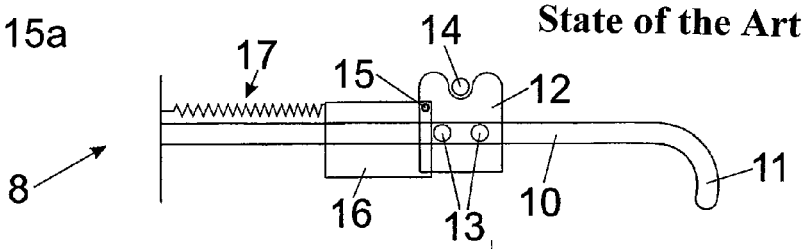
FIGS. 15*a*, 15*b* show two diagrammatically illustrated retraction devices according to the state of the art.
Figure 15B:
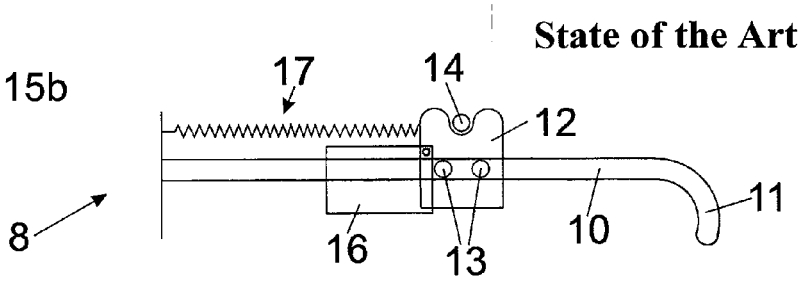
Figure 16A:
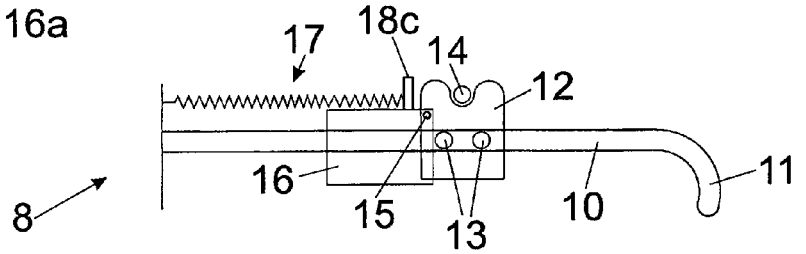
FIGS. 16*a*-16*c* are diagrammatic views of the extension process of a retraction device according to the invention as further developed from FIGS. 15*a* and 15*b*.
Figure 16B:
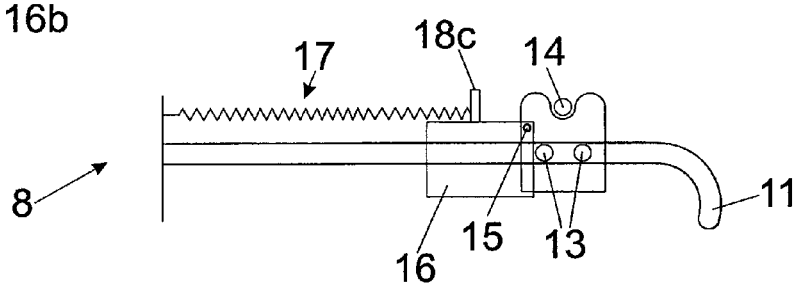
Figure 16C:
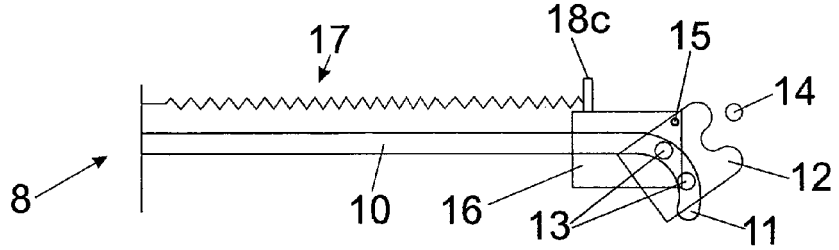

FIGS. 16*a*-16*c* diagrammatically show time sequences of the extension process of a retraction device 8 which represents a development of the retraction devices 8 which are already known, as shown in FIGS. 15 and 15*b*. It is possible to see the linearly displaceable slider 16 on which the entrainment member 12 is mounted about an axis of rotation 15. Mounted on the slider 16 is the articulation mounting part 18*c* of the spring device 17 which in FIG. 16*a* is near the entrainment member 12. In an extension movement of the drawer 3*a* the articulation mounting part 18*c* of the spring device 17 drops back relative to the displacement path 10 of the entrainment member 12 as is shown in FIG. 16*b*. FIG. 16*c* shows the tilted position of the entrainment member 12 which has already released the coupling element 14 of the drawer 3*a*. It will be seen that the stressing travel of the spring device 17, by virtue of the illustrated position of the articulation mounting part 18*c*, is less than the displacement path 10 of the entrainment member 12 so that the entrainment member 12 can be transferred into the tilted parking position, under a reduced tensile loading.

Figure 17:
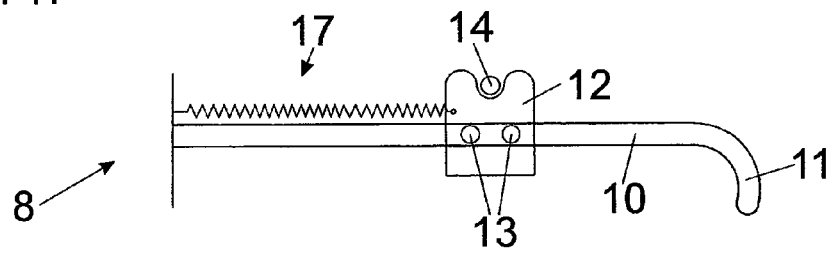
FIG. 17 shows a further diagrammatically illustrated embodiment of a retraction device according to the state of the art.
Figure 18A:
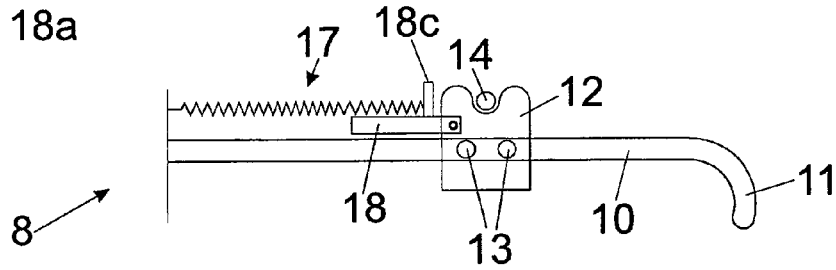
FIGS. 18*a*-18*c* are diagrammatic views of the extension process of a retraction device according to the invention as further developed from FIG. 17.
Figure 18B:
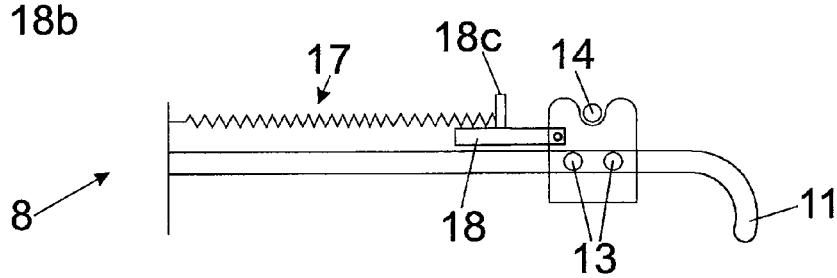
Figure 18C:
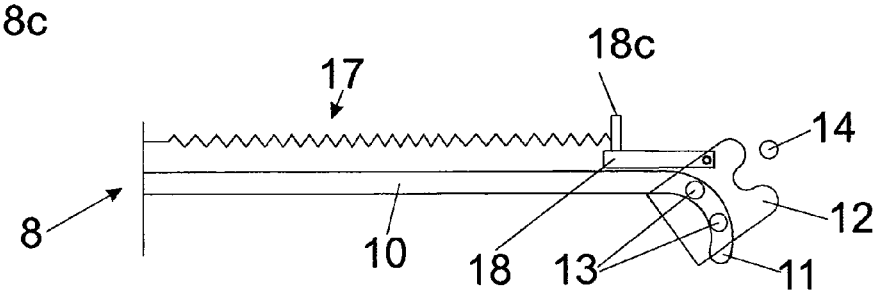

FIGS. 18*a*-18*c* show time sequences of the extension process by reference to a development of this configuration according to the state of the art shown in FIG. 17. In FIG. 18*a* the spring device 17 is coupled to the entrainment member 12 by way of a spring holder 18. When now the drawer 3*a* is pulled the articulation mounting part 18*c* drops back relative to the entrainment member 12 (FIG. 18*b*). FIG. 18*c* shows the tilted position of the entrainment member 12, wherein the coupling element 14 has already been released. In that case the articulation mounting part 18*c* of the spring device 17 was moved relative to the entrainment member 12 at a reduced speed in order in that way to reduce the maximum stress on the entrainment member 12 and thus permit the entrainment member 12 to move into the parking position more gently.

Figure 19:
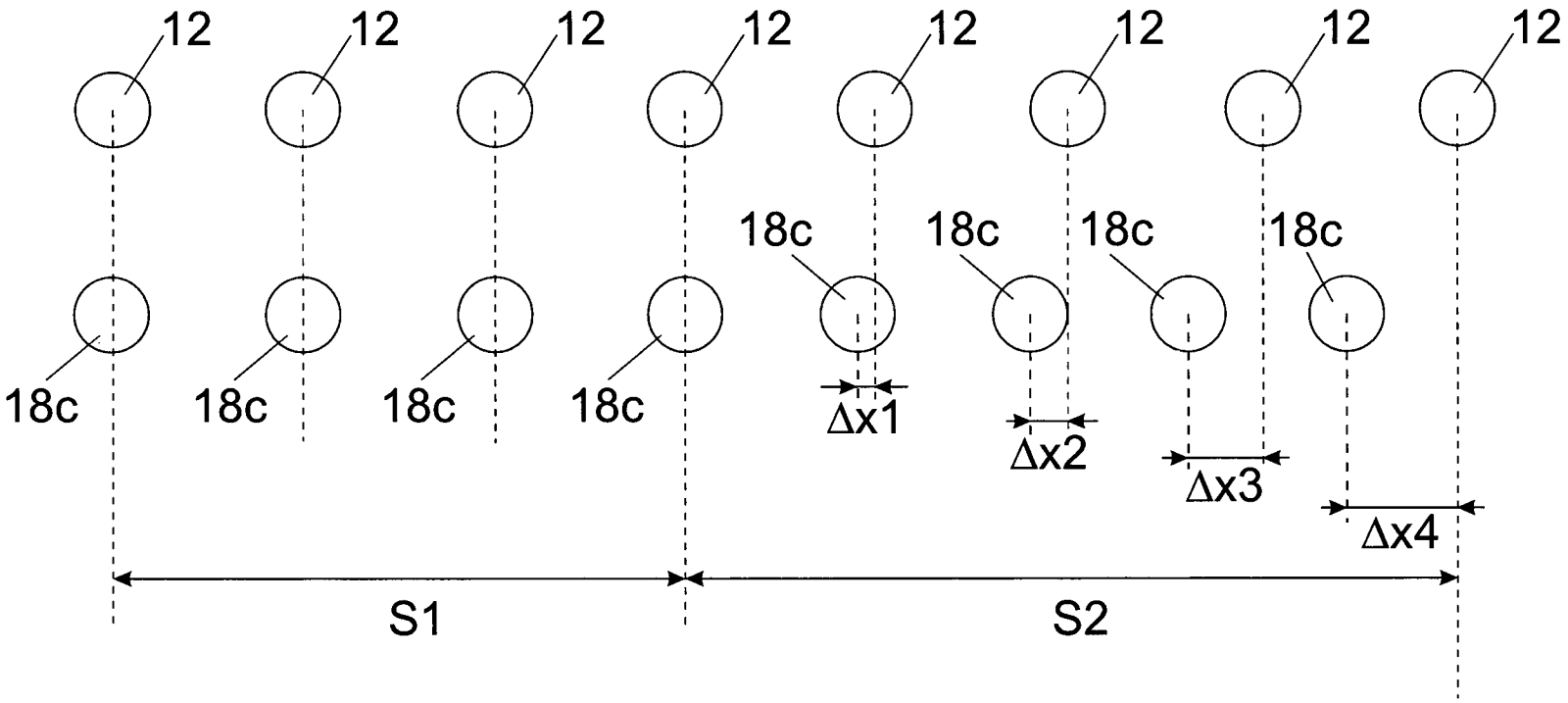
FIG. 19 is a diagrammatic view of the position of the spring articulation mounting point which is falling back relative to the position of the moving entrainment member.

FIG. 19 shows a diagrammatic view of the spring articulation mounting part 18*c* as it falls back, relative to the position of the moving entrainment member 12. Starting from the closed position in which the spring device 17 is substantially relieved of stress the spring articulation mounting point 18*c*, when the entrainment member 12 is pulled out, is moved along the first displacement travel S1 substantially at the same speed as the entrainment member 12. Along a second displacement travel S2 adjoining the first displacement travel S1 the articulation mounting point 18*c* of the spring device 17 drops back further and further relative to the position of the moving entrainment member 12, as will be clear from the ever increasing travel spacings ΔX1, ΔX2, ΔX3, ΔX4 between the entrainment member 12 and the spring articulation mounting point 18*c*.

The present invention is not limited to the illustrated embodiments but embraces or extends to all variants and technical equivalents which can fall within the scope of the accompanying claims. The positional references adopted in the description such as for example "up", "down", "lateral" and so forth are also related to the usual position of installation of the components used and to the illustrated Figure and are to be appropriately transferred to the new position upon a change in position. The control curve 21 can be formed by any device which only permits a substantially line-shaped movement. The control curve 21 can be straight or curved or can also be portion-wise straight and/or portion-wise curved. It should also be noted that an electric motor can also be provided to drive the entrainment member 12. In addition, the described retraction device 8 can be used not only for drawers 3*a* or drawer extension guides 4, but generally for movable furniture parts 3 like sliding doors, pivotable doors, flaps or the like. When using the retraction device 8 with drawer extension guides 4, it can be provided that the retraction device 8 is arranged on the carcass rail 5 and the coupling element 14 is arranged on the central rail 6, the drawer rail 7 or on the drawer 3*a*. In a mechanical reversal, it will be appreciated that it is also possible for the retraction device 8 to be mounted to the central rail 6, to the drawer rail 7 or to the drawer 3*a* while the coupling element 14 is arranged on the carcass rail 5 or another component fixed with respect to the furniture carcass.

The invention claimed is:

1. A retraction device for retracting a movably supported furniture part into a closed end position relative to a furniture carcass, said retraction device comprising:

a body having a displacement path and a control curve path, at least a portion of said displacement path being a linear guide path;

an entrainment member to be releasably coupled to the movable furniture part, said entrainment member being supported movably along said displacement path;

a spring device for applying a closing force to said entrainment member;

a displaceable slider connected to said entrainment member so as to move when said entrainment member moves;

a spring holder separate from said entrainment member for stressing said spring device, said spring holder being movably supported at or on said entrainment member, said spring holder including:

an articulation mounting part;

a spring connection portion fixed to said spring device; and a tilting portion pivotally connected to said spring connection portion via said articulation mounting part, said tilting portion having a guide portion engaging said control curve path of said body so as to be supported movably along said control curve path; and a coupling device for motionally coupling said entrainment member and said spring holder together, said coupling device including a pinion-shaped first tooth arrangement integrally formed on said tilting portion of said spring holder and a linear second tooth arrangement on said slider engaging said first tooth arrangement, said coupling device being configured such that:

said articulation mounting part of said spring holder fixed to said spring device falls back relative to a position of said entrainment member as said entrainment member is being pulled outwardly in an opening direction; and said spring holder and said entrainment member remain coupled together so that both said entrainment member and said spring holder including said articulation mounting part continue to move in the opening direction at different speeds while said articulation mounting part falls back relative to the position of said entrainment member, a movement of said articulation mounting part of said spring holder being slower than a movement of said entrainment member.

2. The retraction device according to claim 1, wherein said coupling device is configured such that said articulation mounting part of said spring holder falls back relative to the position of said entrainment member while said entrainment member is being pulled outwardly in the opening direction and before said entrainment member reaches a parking position in which said entrainment member releases a coupling element connected to the movable furniture part.

3. The retraction device according to claim 1, wherein said control curve path is completely separate from said displacement path.

4. The retraction device according to claim 1, wherein said control curve path is formed in said body so that a portion of said control curve path is separate from said displacement path.

5. The retraction device according to claim 1, wherein at least a portion of said control curve path has a linear shape.

6. The retraction device according to claim 1, wherein said control curve path has a curved shape over at least one third of a total length of said control curve path.

7. The retraction device according to claim 1, wherein said entrainment member is supported movably between a parking position, in which said spring device is stressed, and a closed end position, in which said spring device is at least partially relieved of stress.

8. The retraction device according to claim 7, wherein said entrainment member has a guide element for guiding said entrainment member along said displacement path, said guide element being movable into the parking position.

9. The retraction device according to claim 1, wherein said entrainment member is pivotally connected to said slider.

10. The retraction device according to claim 1, further comprising a damping device for damping a movement of said entrainment member.

11. The retraction device according to claim 1, wherein said tilting portion of said spring holder having said pinion-shaped first tooth arrangement of said coupling device thereon is configured to pivot during engagement of said pinion-shaped first tooth arrangement with said linear second tooth arrangement on said slider as said tilting portion moves along said control curve path.

12. A drawer extension guide comprising said retraction device according to claim 1.

13. An article of furniture comprising said retraction device according to claim 1.

* * * * *